US012253343B1

(12) United States Patent
Overton

(10) Patent No.: US 12,253,343 B1
(45) Date of Patent: Mar. 18, 2025

(54) MEDIUM CALIBER POLYMER AMMUNITION CARTRIDGE

(71) Applicant: True Velocity IP Holdings, LLC, Garland, TX (US)

(72) Inventor: Kenneth J. Overton, Princeton, TX (US)

(73) Assignee: True Velocity IP Holdings, Inc., Garland, TX (US)

( * ) Notice: Subject to any disclaimer, the term of this patent is extended or adjusted under 35 U.S.C. 154(b) by 0 days.

(21) Appl. No.: 18/385,312

(22) Filed: Oct. 30, 2023

(51) Int. Cl.
*F42B 5/313* (2006.01)
*F42C 19/08* (2006.01)

(52) U.S. Cl.
CPC ..... *F42B 5/313* (2013.01); *F42C 19/083* (2013.01)

(58) Field of Classification Search
CPC ..... F42B 5/307; F42B 5/313; F42B 5/297; F42B 5/26
USPC ..... 102/464–467
See application file for complete search history.

(56) References Cited

U.S. PATENT DOCUMENTS 2,862,446 A 12/1958 Lars
3,099,958 A 8/1963 Daubenspeck et al.
3,842,739 A 10/1974 Scanlon et al.
4,867,065 A 9/1989 Kaltmann et al.
5,033,386 A * 7/1991 Vatsvog ..... F42B 5/307 102/467
5,515,783 A 5/1996 Hesse et al.
7,607,392 B2 * 10/2009 Stock, Jr. ..... F42B 5/26 86/19.5
7,610,858 B2 11/2009 Chung
8,443,730 B2 5/2013 Padgett
8,561,543 B2 10/2013 Burrow
8,869,702 B2 10/2014 Padgett
8,875,633 B2 11/2014 Padgett
9,528,799 B2 12/2016 Maljkovic
10,365,074 B2 * 7/2019 Burrow ..... F42B 5/307
10,948,272 B1 3/2021 Drobockyi et al.
11,768,059 B2 * 9/2023 Burrow ..... F42B 5/285 102/466
2005/0005807 A1 1/2005 Wiley et al.
2005/0056183 A1 3/2005 Meshirer
2007/0214992 A1 9/2007 Dittrich
2007/0261587 A1 11/2007 Chung
2011/0179965 A1 * 7/2011 Mason ..... F42B 5/307 102/466
2013/0180392 A1 7/2013 Nuetzman et al.
(Continued)

*Primary Examiner* — Reginald S Tillman, Jr.
(74) *Attorney, Agent, or Firm* — Burdick Patents, P.A.; Sean D. Burdick; Colin L. Honan

(57) ABSTRACT

A medium caliber polymer-based ammunition cartridge has an insert forming a base end and engaged to a polymer body forming an internal propellant chamber. The polymer body is engaged at its forward end to a polymer nose which has a shoulder that transitions directly into a projectile opening. The shoulder is inwardly radially thickened to increase lateral support about a medium caliber projectile loaded into the cartridge. The thickness of the shoulder may vary along its longitudinal length. One or more crush seals may be integrally formed about an outer surface of the cartridge nose. The crush seals include an annular tip seal and one or more annular shoulder seals. Each of the crush seals deform into an obturating ring to form a seal between the outer surface of the medium caliber polymer cartridge and the inner walls of the firing chamber.

19 Claims, 2 Drawing Sheets

(56) References Cited

U.S. PATENT DOCUMENTS

| | | | |
|---|---|---|---|
| 2013/0305951 | A1 | 11/2013 | Davies et al. |
| 2014/0060372 | A1 | 3/2014 | Padgett |
| 2014/0076188 | A1 | 3/2014 | Maljkovic et al. |
| 2014/0290522 | A1 | 10/2014 | Padgett |
| 2015/0033970 | A1 | 2/2015 | Maljkovic et al. |
| 2015/0075400 | A1 | 3/2015 | Lemke et al. |
| 2016/0091288 | A1 | 3/2016 | Daniau |
| 2021/0041211 | A1 | 2/2021 | Pennell et al. |

* cited by examiner

MEDIUM CALIBER POLYMER AMMUNITION CARTRIDGE

BACKGROUND OF THE INVENTION

Field of the Invention

The present invention relates generally to ammunition cartridges and, more particularly to medium caliber polymer-based ammunition cartridges.

Description of Related Art

Conventional small caliber ammunition cartridges have long been made from brass, which is expensive, heavy, and potentially hazardous. In terms of military use, the weight of brass cartridges en masse adds to the overall weight a soldier or vehicle must carry. The combined weight limits the amount of brass cartridges that the individual soldier can carry on their person and presents further logistical issues for transportation and use by military vehicles. For instance, a box of .50 caliber brass ammunition cartridges plus links can weigh about 35 pounds (100 brass cartridges plus links). Military personnel and vehicles, especially winged and rotary vehicles such as fighter jets or helicopters, are therefore limited in the quantity of cartridges they can carry due to the significant weight of these cartridges when considered en masse.

These logistical problems are further exacerbated when considering medium and large caliber ammunition cartridges, which are most common in vehicle-mounted weapons platforms. Many of the medium caliber vehicle-mounted weapons platforms have extremely high rates of fire, sometimes having the capability to exceed 6,000 rounds per minute of fire. These vehicles are therefore typically equipped with several hundred to several thousand rounds of ammunition, depending on the vehicle and corresponding weight limitations. One common type of vehicle-mounted medium caliber weapons platform utilizes 20 millimeter (hereinafter "20 mm") caliber projectiles. Depending on the cartridge design and the propellant load used therein, a single 20 mm cartridge fully assembled can weigh over 10 ounces. This presents a significant limiting factor for the amount of ammunition a vehicle can carry, particularly in winged or rotary vehicles such as fighter jets and helicopters. For instance, an F-16 fighter jet equipped with a M61A1 20 mm weapons platform can achieve a rate of fire up to 6,000 rounds per minute but logistically can only carry about 510 rounds of 20 mm cartridges, weighing in at about 325 pounds.

The extremely high rate of fire that many medium caliber weapons platforms can achieve creates additional problems beyond logistical issues in transportation and loadout. The metallic cartridges used for medium caliber ammunition transfer significant heat to the weapons platform thereby reducing the life of the weapon. To compensate for this, the M61A1 20 mm weapon is designed with six rotating barrels, which allows five barrels to cool down while the remaining barrel is fired. However, even with the six-barrel design of the M61A1 20 mm weapon, each individual barrel has a life expectancy of roughly 15,000 rounds, which is particularly low considering the extremely high rate of fire that is possible.

There has thus been a long-term need for a lighter weight alternative to the conventional brass ammunition cartridge. Polymer cartridges have been considered a desirable alternative to brass cartridges for decades but prior polymer cartridges have not yet met industry and military performance standards. The problems with polymer ammunition cartridges are compounded further in the case of medium caliber ammunition cartridges due to the significantly higher energy that is released and the extremely high rates of fire that are common with medium caliber weapons platforms.

SUMMARY OF THE INVENTION

The invention disclosed herein relates to medium caliber ammunition cartridges. The invention provides a polymer-based ammunition cartridge that has been engineered to withstand the significantly higher ballistic requirements of medium caliber cartridges while maintaining operability with existing weapons platforms. The disclosed medium caliber polymer cartridge is lighter than equivalent metallic cartridges of the same caliber and size and significantly reduces the amount of heat transferred to the weapons platform to thereby increase the overall serviceable life of the weapon.

In one embodiment, the medium caliber polymer cartridge has a three-piece design. The base end is formed by an insert which is engaged to a polymer body. The insert has a top and bottom surface with a coupling element extending from the top surface. A primer pocket is formed through the bottom surface and a flash hole, in communication with the primer pocket, is formed through the top surface. The lower end of the polymer body is molded over the coupling element to define an internal propellant chamber. The opposite, forward end of the polymer body defines a nose joint for coupling to the cartridge nose. The cartridge nose includes a shoulder transitioning directly into the projectile opening. The thickness of the nose varies along its longitudinal length, from the nose joint to the projectile opening.

In some embodiments, the shoulder is designed to partially enclose a driving band that is formed about the outer surface of the projectile to be fired from the cartridge. A gap may be formed between the partially enclosed driving band and an inner surface of the shoulder, which may be used to introduce a sealant into the cartridge. The sealant applied to the gap will protect the internal propellant chamber from environmental contaminants, such as water, that may otherwise seep into the propellant chamber. In alternative embodiments, the shoulder may fully enclose the driving band thereby sealing the projectile opening about the driving band.

In some embodiments, an annular ridge may be formed about the inner surface of the shoulder. The annular ridge is designed to frictionally engage with a cannelure formed about the outer surface of the projectile to be fired from the cartridge. The annular ridge may be designed with three distinct sides: a proximal side, a distal side, and a flat side. The proximal side and the distal side are integrally connected by the flat side. In some preferred embodiments, the proximal side and the distal side may be angled to control the amount of force required to seat the projectile in the nose and the force required for the subsequent release of the projectile upon firing.

In further embodiments, the varying thickness of the cartridge nose at the forward end thereof can taper from the shoulder to the projectile opening. An internal annular seat may be formed about the projectile opening. The annular seat defines an internal diameter that is greater than the inner diameter of the shoulder. In some embodiments, the annular seat is designed to seat the driving band to ensure the projectile is seated to the correct depth from round to round.

In some preferred embodiments, the cartridge nose is integrally formed with an annular tip seal. Preferably, the annular tip seal is formed about the distal end of the projectile opening and is designed to deform under the forward axial movement of the cartridge in a firing chamber. Deformation of the annular tip seal creates an obturating ring that forms a seal between the distal end of the projectile opening and the firing chamber of the firearm. In some embodiments, the annular tip seal has a semi-circular cross-sectional design, but other cross-sectional designs may also be acceptable. The cartridge nose may also include one or more annular shoulder seals integrally formed about the outer surface of the shoulder. The one or more annular shoulder seals are similarly designed to deform under the forward axial movement of the cartridge in the firing chamber to provide one or more obturating rings, depending on the number of annular shoulder seals. Each of the one or more obturating rings individually forms a seal between the outer surface of the shoulder and the firing chamber. The annular tip seal and/or the one or more annular shoulder seals prevent propellant gases from escaping into the firing chamber and ensure that the gases are released out the barrel along with the projectile.

In some embodiments, the medium caliber polymer-based ammunition cartridge is designed as a 20 mm caliber cartridge.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

DETAILED DESCRIPTION OF THE INVENTION

The following disclosure presents exemplary embodiments of medium caliber polymer-based ammunition cartridges and projectiles specially designed to be loaded therein. The disclosed polymer-based ammunition cartridges are engineered to provide the necessary lateral support about the cartridge mouth to ensure the heavier projectiles can be properly seated therein. Further, the invention disclosed herein is designed to generate a bullet-pull value that meets or exceeds the relevant military requirements for the given caliber and weapons platform corresponding to the intended use of the cartridge. This ensures cartridges designed according to the present inventive concepts can withstand handling and transport loads without the projectile becoming dislodged or otherwise moving from its properly seated position.

Applicant notes use of the term "polymer" throughout this disclosure shall be interpreted in a non-limiting fashion and given broad interpretation according to its plain and ordinary meaning. "Polymer" can mean a natural polymer or a synthetic polymer. Examples of polymers as used herein include but are not limited to acrylic, polyethylene, polyolefin, polypropylene, polystyrene, polyvinylchloride, synthetic rubber, phenol formaldehyde, neoprene, nylon, polyacrylonitrile, PVB, silicone, and any of the foregoing in powdered, micronized powdered, or resin form. The polymer can further be homogeneously mixed with one or more conventional filler materials, such as glass filler. Further, the use of the phrase "small caliber" is meant to designate ammunition cartridges of 50 caliber (12.7 mm) and below; the use of the phrase "medium caliber" is meant to designate ammunition cartridges between 20 mm caliber and up to 57 mm caliber; and the use of the phrase "large caliber" is meant to designate ammunition cartridges having a caliber greater than 58 mm. Further, throughout the disclosure Applicant may use terms such as "distal" and "proximal" to describe particular features of the inventive cartridge. It should be understood that such directional references are made with regard to an ammunition cartridge oriented in a firing chamber so that the "distal end" or "forward end" is the end of the cartridge engaged to a projectile and the "proximal end" is the base end.

The inventive concepts disclosed herein are particularly useful with medium caliber ammunition cartridges. The specific structural design of the disclosed polymer-based cartridges has been engineered to withstand the higher ballistic demand requirements of medium caliber ammunition cartridges while maintaining operability with existing weapons platforms.

Figure 1:
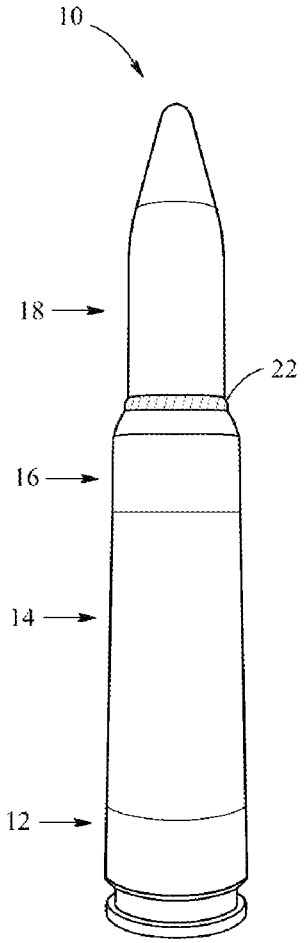
FIG. 1 is a side view of an embodiment of a medium caliber polymer based ammunition cartridge loaded with a medium caliber projectile according to the present invention.

FIG. 1 is a side view of an embodiment of a medium caliber polymer-based ammunition cartridge 10 according to the present invention. The polymer-based cartridge 10 illustrated in FIG. 1 is an exemplary embodiment of a 20 mm caliber ammunition cartridge according to the present invention. The depicted embodiment is meant solely for illustrative purposes and the inventive concepts disclosed herein are not limited to 20 mm caliber cartridges but can be applied in all medium caliber ammunition, as that term has been defined herein, including up to 57 mm caliber cartridges.

The medium caliber polymer cartridge 10 can include an insert 12 forming the base end of the cartridge. Connected to the insert 12 is a cartridge body 14 which extends forward toward the cartridge nose 16. A projectile 18 is engaged to a projectile opening 20 defined at the distal end of the cartridge nose 16. As is common for most medium caliber and large caliber projectiles, the projectile 18 includes a rotating band or driving band 22 formed about the circumference of the projectile 18 proximate to the lower or base end thereof. The driving band 22 serves multiple purposes in medium and large caliber projectiles, such as projectile 18. The driving band 22 is designed to engage the internal rifling of a firearm barrel to impart a stabilizing spin to a fired projectile during flight. Further, driving band 22 serves as an obturating ring sealing the firearm barrel about the projectile to prevent propellant gases from escaping past the projectile as it travels the length of the barrel. The outer diameter of the driving band 22 is therefore slightly greater than the outer diameter of the projectile 18 to ensure the band sufficiently contacts the rifling of the barrel as the projectile passes therethrough.

Figure 2:
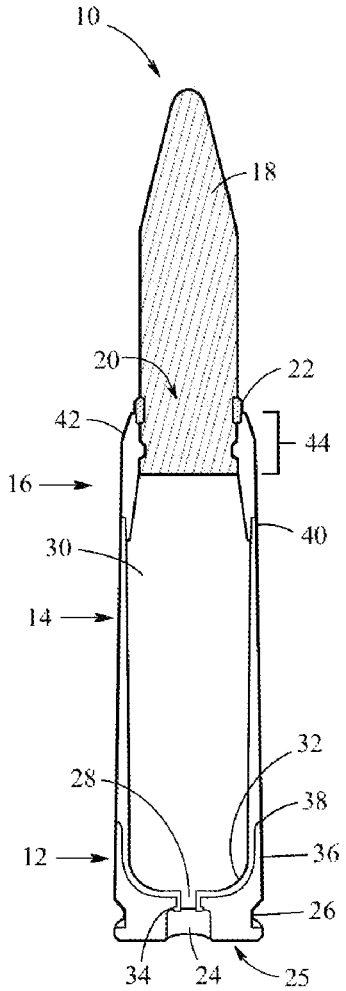
FIG. 2 is a cross-sectional view of the cartridge of FIG. 1 cut vertically in half and shown loaded with a medium caliber projectile according to the present invention.

FIG. 2 is a side cross-sectional view of an embodiment of a medium caliber polymer cartridge 10, according to the present invention. The insert 12 has a primer pocket 24 defined through the bottom surface 25. An extraction flange and groove 26 are formed about the circumference of the bottom surface 25. A flash hole 28 fluidically connects the primer pocket 24 with an internal powder chamber 30 formed by the cartridge body 14. In some embodiments, the flash hole 28 may be overmolded 32 with polymer material of the cartridge body 14 during the manufacturing process to ensure that a secure and reliable connection has been established. The overmold 32 may flare out about the upper surface of the primer pocket 24 to further strengthen the connection therebetween. In some embodiments, the upper surface of the primer pocket 24 may include a groove 34 proximate the flash hole 28 to receive the flared-out portion of the overmold 32. The primer pocket 24 is configured to receive a primer therein and upon firing will ignite the internal powder charge in the propellant chamber 30 through the overmolded 32 flash hole 28.

The insert 12 has a forward coupling element 36 forming an insert joint 38 which is configured to engage the cartridge body 14. Engagement of the cartridge body 14 about the insert joint 38 forms the overmold 32 as the polymer material from the cartridge body 14 flows down the coupling element and extends through the flash hole 28 during the molding process. The thickness of the cartridge body 14 tapers from the insert joint 38 to a forward nose joint 40, which is configured to engage the cartridge nose 16. The cartridge nose 16 includes a shoulder 42 that transitions directly into the projectile opening 20.

To ensure compatibility with existing weapons platforms with only slight modification to the firing chamber, the cartridge body 14 can be elongated in comparison to the same caliber of cartridge in conventional metal form. For instance, the M61A1 weapons platform described above is typically chambered for a 20 mm×102 mm medium caliber cartridge. The 102 mm designates the cartridge length without accounting for the projectile. Thus, for the disclosed medium caliber polymer cartridge 10 to be compatible with such weapon, the overall axial length from the base end 25 to the projectile opening 20 must be substantially equal to 102 mm. To compensate for the elimination of a cartridge neck, as would be conventionally found in the metallic 20 mm×102 mm cartridge, the cartridge body 14 is elongated so that the total axial length from the base end 25 to the projectile opening 20 is substantially equal to the required 102 mm length. With the cartridge body 14 elongated to compensate for the lack of a neck, the firing chamber of a weapons platform need only be slightly reamed in the forward-bore end to provide adequate radial support about cartridge nose 16. Further, by elongating the cartridge body 14, the internal propellant chamber 30 is made larger and can hold an increased powder load thereby increasing the ballistic characteristics for the cartridge 10 in comparison to the same caliber in a conventional metal cartridge.

In some embodiments, the cartridge body 14 may be elongated by about 5% to about 15% beyond the length of a metallic cartridge body for a cartridge of the same type and caliber. For instance and continuing with the above 20 mm×102 mm example, the typical length of the cartridge body, measured from the base end to the start of the shoulder, in a metallic 20 mm×120 mm cartridge is substantially equal to about 84 mm. The shoulder and neck combine to make up the remaining 18 mm of axial length to achieve the required 102 mm cartridge length. The cartridge body 14 of the disclosed medium caliber polymer cartridge 10 therefore may be increased by about 5% to about 15% to form a length of the cartridge body 14 that is substantially between about 88.2 mm to about 96.6 mm with the remainder of the axial length formed by the cartridge nose 16. The skilled artisan will readily recognize that the relative size of the various components can be easily determined by visually inspecting and measuring the conventional metallic medium caliber cartridge and then applying the inventive principles disclosed herein to determine the needed axial length for the cartridge body 14 in the polymer cartridge 10. Variations of the axial length for the cartridge body 14 within the disclosed range may occur depending on the type of projectile the cartridge will be loaded with and the desired ballistic performance thereof.

Figure 3:
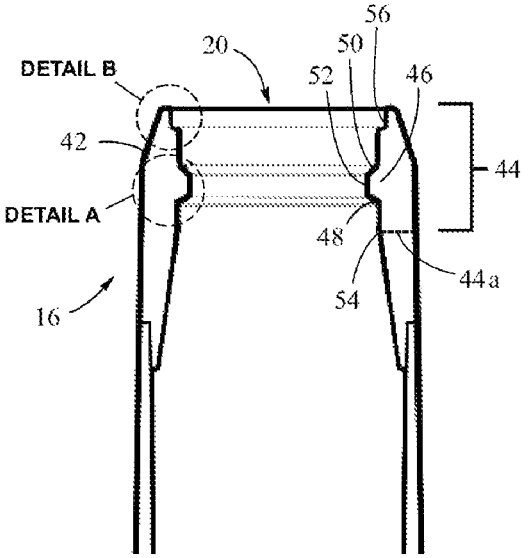
FIG. 3 is a side cross-sectional view of a nose end of an embodiment of a polymer based medium caliber cartridge according to the present invention.
Figure 4:
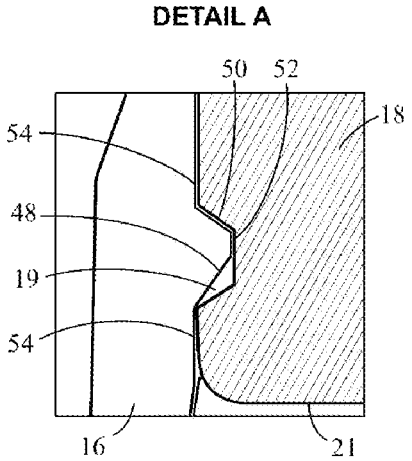
FIG. 4 is magnified view, taken from Detail A in FIG. 3, of a portion of the nose end of the medium caliber cartridge engaged to a portion of a medium caliber projectile.
Figure 5:
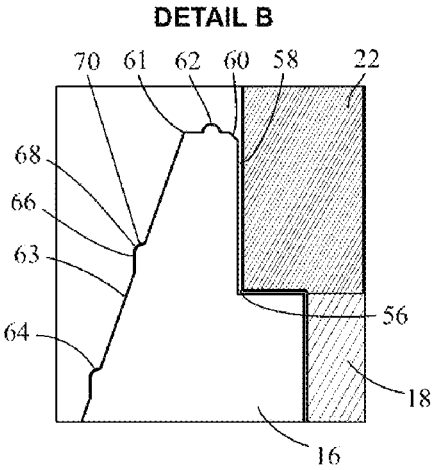
FIG. 5 is a magnified view, taken from Detail B in FIG. 3, of a portion of the nose end of the medium caliber cartridge engaged to a portion of a medium caliber projectile.

FIG. 3 is a side view of an embodiment of a cartridge nose 16 according to the present invention. FIG. 3 also marks various components for magnification in later views. Particularly, FIG. 4 is a magnified view of a portion of the cartridge nose 16 engaged to a portion of the projectile 18, taken from Detail A circled in FIG. 3. Similarly, FIG. 5 is another magnified view of a portion of the cartridge nose 16 engaged to a portion of the projectile 18, taken from Detail B circled in FIG. 3. The nose 16 includes a shoulder 42 transitioning directly into the projectile opening 20. The thickness of the nose 16 varies along the longitudinal length thereof. Preferably, the nose 16 is radially inwardly thickened to provide added lateral support necessary for the increased mass of projectile 18 compared to the mass of small caliber projectiles.

In some embodiments, the nose 16 may be inversely tapered from the nose joint 40 to a projectile support region 44, which is defined as the portion of the nose 16 that provides direct lateral support about the projectile 18 loaded therein. The thickness of the projectile support region 44 varies along its longitudinal length toward the projectile opening 20. In some embodiments, the projectile support region 44 includes an annular ridge 46 formed about the inner surface of the nose 16. The annular ridge 46 is designed to frictionally engage with a groove or cannelure 19 formed about the projectile 18. In contrast to conventional metallic cartridges that utilize a crimping action to secure a projectile in the case mouth, the medium caliber polymer cartridge 10 cannot be properly crimped due to the inherent frangibility of the polymer materials once the cartridge has been formed. The addition of the annular ridge 46 inside the cartridge nose 16 renders the crimping action unnecessary. Further, the annular ridge 46 provides a convenient reference point to ensure the projectile 18 is loaded to the same depth from round to round.

The annular ridge 46 is formed at an intermediate position between the nose joint 40 and the projectile opening 20. Preferably, the annular ridge 46 is formed at an intermediate position between the lower end 44*a* of the projectile support region 44 and the projectile opening 20. The exact positioning of the annular ridge 44 relative to the nose joint 40 and the projectile opening 20 may vary among different embodiments of the medium caliber polymer cartridge 10 depending on the powder load and projectile to be used with the cartridge. High powder loads used in combination with higher-mass projectiles may require the projectile support region 44 to be extended so that the annular ridge 46 can be formed deeper in the nose 16 to ensure the projectile is adequately supported therein.

As shown in FIG. 3 and magnified further in FIG. 4, the annular ridge 46 may be formed of three distinct sides. The proximal side 48 is defined as the side of the annular ridge 46 facing the propellant chamber 30. The distal side 50 is opposite the proximal side and is defined as the side of the annular ridge 46 facing the projectile opening 20. The distal side 50 and the proximal side 48 are integrally connected by the flat side 52 to form the annular ridge 46. In some preferred embodiments, the proximal side 48 has a slanted angle extending from the flat side 52 to the inner wall 54 of the projectile support region 44. The angle of the slanted proximal side 48 is preferably less than 90 degrees. A slanted proximal side 48 will allow the projectile 18 to be more easily and smoothly released upon firing the medium caliber polymer cartridge 10 by reducing the force necessary for the projectile 18 to overcome the annular ridge 46. The angle of the slanted proximal side 48 and height of the flat side 52, defined as the distance the flat side extends inwardly from the inner surface 54, can be selected to control the amount of force needed for the projectile 18 to be released upon firing the cartridge 10.

In further embodiments, the distal side 50 may also have a slanted angle extending from the flat side 52 to an upper portion of the inner wall 54 of the projectile support region 44. Preferably, the angle of the slanted distal side 50 is also less than 90 degrees. The slanted distal side 50 may reduce the amount of force required when seating a projectile 18 in the medium caliber polymer cartridge 10 during an assembly process. Particularly, the slanted distal side 50 reduces the amount of force necessary for the base end 21 of the projectile 18 to overcome the annular ridge 46 to ensure the proper engagement, and thus proper seated depth, of the cannelure 19 and the annular ridge.

Due to the inherent pliability of the polymer materials making up the medium caliber polymer cartridge 10, when the cartridge 10 is not supported within a firing chamber of the firearm, the cartridge nose 16 can flex sufficiently to allow the base end 21 of the projectile 18 to be inserted over the annular ridge 46. In some embodiments, the cartridge nose 16 may be configured to generate at least 100 to 500 pounds of force ("lbf") to properly load a projectile 18 therein while in an unsupported fashion, e.g., when the cartridge is not contained within a firing chamber. Said another way, the internal diameter of the cartridge nose 16 in combination with the specific dimensions of the annular ridge 46 may be designed so that it takes 100 to 500 pounds of force to load the projectile 18 therein and overcome the annular ridge 46. The angle of the slanted distal side 50 may be used to control the amount of force required to load a projectile 18 into the medium caliber polymer cartridge 10 during assembly. As the angle of the slanted distal side 50 approaches 90-degrees, the amount of force required to load the projectile 18 into the cartridge 10 will increase.

When the medium caliber polymer cartridge 10 is loaded into a firearm, the firing chamber provides added support about the cartridge nose 16 thereby reducing the outward flexibility of the nose. The added support about the cartridge nose 16 provided by the firing chamber significantly increases the amount of force required to extract or pull the projectile 18 from the medium caliber polymer cartridge 10. In some preferred embodiments, the added lateral support provided by the firing chamber in combination with the annular ridge 46 results in an at least 750 lbf requirement for the projectile 18 to be released from the cartridge 10. The buildup of pressure in the propellant chamber 30 caused by ignition of the powder charge therein generates sufficient force at the base end 21 of the projectile 18 so that the projectile can overcome the annular ridge 46 and be released from the cartridge. Note, the force required for the projectile 18 to be released from the cartridge 10 is merely a threshold requirement and is not the total force generated upon firing the cartridge by a firearm. The steepness of the slanted proximal side 48 may be used to control the amount of force required to release the projectile 18 from the cartridge 10 upon firing. As the angle of the slanted proximal side 48 approaches 90-degrees, the force required to release the projectile 18 from the cartridge 10 upon firing will increase.

It should be recognized that the specific dimensions of the annular ridge 46 and its subcomponent walls 48, 50, 52 can be used to control the amount of force required for loading and discharging a projectile 18 from the medium caliber polymer cartridge 10. Each of the proximal side 48 and the distal side 50 can be formed independent of one another so that only one includes a slanted angle. Further, both the proximal side 48 and distal side 50 can be formed with slanted angles that differ from one another. The exact dimensions of the annular ridge 46 is therefore dependent on the requirements for the given cartridge 10 being formed and the caliber thereof.

Turning back to FIG. 3, the cartridge nose 16 can also include an annular seat 56 formed about the projectile opening 20. The annular seat 56 defines a depth from the projectile opening 20 which encloses, at least partially, the driving band 22 of a projectile 18 loaded into the cartridge 10. Further, the annular seat 56 provides a convenient reference point for projectile loading depth to ensure the projectiles are seated to the same depth from round to round. The depth of the annular seat 56, measured as the distance from the projectile opening 20, can vary depending on the projectile 18 loaded therein and ballistic requirements of the cartridge 10. In some embodiments, the depth of the annular seat 56 may be such that the entire longitudinal length of the driving band 22 is enclosed within the cartridge nose 16 about the projectile opening 20. In these embodiments, it may be preferred that the internal diameter about the annular seat 56 is substantially equal to the outer diameter of the driving band 22 to seal shut the projectile opening 20 once the cartridge 10 has been assembled.

In alternative embodiments, such as that shown in the magnified view of FIG. 5, the depth of the annular seat is such that only part of the driving band 22 is enclosed within the cartridge nose 16 about the projectile opening 20. In these embodiments, it is preferred that the internal diameter about the annular seat 56 is slightly greater than the outer diameter of the driving band 22 to allow formation of a sealant path 58 therebetween. During assembly, a waterproofing sealant may be introduced to the sealant path 58 after the projectile 18 has been seated in the cartridge nose 16 to prevent environmental contaminants from reaching the internal propellant chamber 30. Preferably, the distal end of the annular seat 56 has a chamfered or beveled internal tip 60. The beveled internal tip 60 can improve sealant introduction into the sealant path 58 by providing a convenient reference point to orient the flow of sealant into the path 58.

Continuing with FIG. 5, the cartridge nose 16 can have one or more annular crush seals 62, 64 formed about the outer surface of the nose. The one or more annular crush seals 62, 64 are designed to deform under the forward axial tension exerted on the cartridge 10 during chambering and firing events to form an obturating ring to seal off the firing chamber from gases escaping rearwards into the firing chamber. The crush seals 62, 64 can be small protrusions integrally formed with and extending from the outer surface 63 of the nose 16.

The crush seals can include an annular tip seal 62 and one or more annular shoulder seals 64. The annular tip seal 62 is preferably formed at the distal end 61 of the cartridge nose 16 circumvolving the projectile opening 20. The annular tip seal 62 can have a semi-circular cross-sectional design to ensure the seal is sufficiently crushed under the forward axial movement to seal off the firing chamber behind it.

In contrast to the annular tip seal 62, the annular shoulder seals 64 are preferably formed about the outer surface 63 of the cartridge nose 16. There may be multiple annular shoulder seals 64 formed about the outer surface 63. In some embodiments, the multiple annular shoulder seals 64 may be arranged at varying positions of the cartridge nose to form multiple levels of obturation, when the shoulder seals are deformed.

The annular shoulder seals 64 are designed to allow the medium caliber polymer cartridge 10 to be withdrawn from its mold during the manufacturing process. To ensure such ready withdrawal capability, the annular shoulder seals 64 are molded with a sloped proximal leg 66 extending to an apex 68. The angle of the sloped proximal leg 66 is preferably less than 90 degrees to allow removal of the cartridge 10 from the corresponding mold during manufacture. The 90 degree angle is taken with respect to a horizontal axis defined by the most proximal surface of the cartridge base, which would be zero degrees if taken with respect to the parallel longitudinal axis of the cartridge body. Hereafter, the angles of the sloped proximal leg 66 are expressed with respect to a counterclockwise rotation from the aforesaid horizontal axis. In some embodiments, the angle of the sloped proximal leg 66 may be substantially equal to about 15 degrees to about 60 degrees, more preferably between about 25 degrees to about 35 degrees. The sloped proximal leg 66 also increases the ease with which the medium caliber polymer cartridge 10 can be extracted after firing. The annular shoulder seals 64 also include a sloped distal leg 70 which has an angle steeper than the angle of the sloped proximal leg 66. The steeper angle of the sloped distal side 70 ensures the annular shoulder seals 64 will sufficiently engage with an inner wall of the firing chamber so as to cause the deformation of the seals into the one or more obturating rings. While FIG. 5 illustrates two annular shoulder seals 64, the skilled artisan will recognize that more than two shoulder seals are possible depending on the requirements of the cartridge 10.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A medium caliber polymer-based ammunition cartridge, comprising:

an insert having a top surface and a bottom surface, a coupling element extending from the top surface, a primer pocket formed through the bottom surface, and a flash hole in fluid communication with the primer pocket and extending through the top surface;

a polymer body engaged to the insert forming an internal propellant chamber, wherein a first end of the polymer body is molded about the coupling element and into the flash hole and wherein a second end, opposite the first end, forms a nose joint;

a nose engaged to the nose joint of the polymer body and having a shoulder transitioning into a projectile opening, wherein thickness of the nose varies radially from the nose joint to the projectile opening and wherein the shoulder is configured to at least partially enclose a driving band engaged about an outer surface of a medium caliber projectile loaded into the cartridge.

2. The cartridge of claim 1, further comprising a gap formed between an inner surface of the shoulder and the at least partially enclosed driving band.

3. The cartridge of claim 2, further comprising a sealant applied to the gap.

4. The cartridge of claim 1, wherein the shoulder fully encloses the driving band of the medium caliber projectile.

5. The cartridge of claim 4, wherein the enclosed driving band seals the projectile opening about the engaged medium caliber projectile.

6. The cartridge of claim 1, further comprising an annular ridge formed about an inner surface of the shoulder.

7. The cartridge of claim 6, wherein the annular ridge is configured to frictionally engage a cannelure formed on an outer surface of a projectile to secure the projectile within the nose.

8. The cartridge of claim 1, wherein the varying thickness of a forward end of the nose tapers from the shoulder to the projectile opening.

9. The cartridge of claim 8, wherein the forward end of the shoulder further comprises an internal annular seat formed proximate to the projectile opening, the annular seat defining an inner diameter that is greater than an inner diameter of the shoulder.

10. The cartridge of claim 1, wherein the nose further comprises an annular tip seal integrally formed about a distal end of the projectile opening.

11. The cartridge of claim 10, wherein the annular tip seal is configured to deform into an obturating ring when crushed by the forward axial movement of the cartridge in a firing chamber.

12. The cartridge of claim 11, wherein the obturating ring forms a seal about the distal end of the projectile opening and the firing chamber.

13. The cartridge of claim 1, wherein the nose further comprises one or more annular shoulder seals integrally formed about an outer surface of the shoulder.

14. The cartridge of claim 13, wherein each of the one or more shoulder seals are configured to allow withdrawal of the cartridge from a cartridge mold.

15. The cartridge of claim 13, each of the one or more shoulder seals further comprising a proximal slope extending from the outer surface and defining an angle less than 90 degrees with respect to a horizontal axis defined by a proximal end of the insert.

16. The cartridge of claim 13, wherein each of the one or more shoulder seals is configured to deform into an obturating ring when crushed by the forward axial movement of the cartridge in a firearm chamber.

17. The cartridge of claim 16, wherein each obturating ring forms a seal between the outer surface of the shoulder and the firearm chamber.

18. The cartridge of claim 1, wherein the polymer body is axially elongated by about 5% to about 15% in comparison to a conventional medium caliber metal cartridge having a similar total axial length requirement as the medium caliber polymer cartridge.

19. A medium caliber polymer based ammunition cartridge, comprising:

an insert forming a base end engaged to a cartridge body defining an internal powder chamber;

a nose extending forward from the cartridge body opposite the insert, the nose having a rounded shoulder which transitions into a projectile opening; and an internal annular seat formed about the projectile opening and configured to receive at least a portion of a driving band engaged to a medium caliber projectile loaded into the cartridge, wherein the outer surface of the shoulder at least partially encloses the driving band.

* * * * *